US009995105B2

(12) United States Patent
Miller et al.

(10) Patent No.: US 9,995,105 B2
(45) Date of Patent: Jun. 12, 2018

(54) METHOD OF PLACING CEMENT SEALING RINGS AT PREDETERMINED ANNULAR LOCATIONS AROUND A TUBULAR STRING

(71) Applicant: BAKER HUGHES INCORPORATED, Houston, TX (US)

(72) Inventors: Troy A. Miller, Bellville, TX (US); Jeffery L. Knippa, Point Venture, TX (US)

(73) Assignee: Baker Hughes, a GE company, LLC, Houston, TX (US)

( * ) Notice: Subject to any disclaimer, the term of this patent is extended or adjusted under 35 U.S.C. 154(b) by 349 days.

(21) Appl. No.: 14/713,516

(22) Filed: May 15, 2015

(65) Prior Publication Data

US 2016/0333659 A1 Nov. 17, 2016

(51) Int. Cl.
*E21B 33/13* (2006.01)

(52) U.S. Cl.
CPC ..... *E21B 33/13* (2013.01)

(58) Field of Classification Search
CPC ..... E21B 33/13
See application file for complete search history.

(56) References Cited

U.S. PATENT DOCUMENTS

| | | | | |
|---|---|---|---|---|
| 3,358,770 | A * | 12/1967 | Solis | E21B 33/146 137/543.13 |
| 4,319,638 | A * | 3/1982 | Baker | E21B 33/124 166/129 |
| 5,082,062 | A | 1/1992 | Wood et al. | |
| 5,186,258 | A | 2/1993 | Wood et al. | |
| 5,366,019 | A | 11/1994 | Brooks | |
| 5,692,564 | A | 12/1997 | Brooks | |
| 2006/0144590 | A1* | 7/2006 | Lopez de Cardenas | E21B 43/14 166/276 |
| 2013/0264068 | A1* | 10/2013 | Hanson | E21B 21/103 166/373 |

* cited by examiner

*Primary Examiner* — Brad Harcourt
(74) *Attorney, Agent, or Firm* — Steve Rosenblatt

(57) ABSTRACT

A method of providing cement isolators in an annular space about a tubular string in open hole uses a straddle tool that sequentially engages profiles in the tubular string so that prepositioned communication valves to the surrounding annulus can be straddled to force cement out through the straddle tool and into the annular space. The cement is formulated to stay in position and set up. Each valved opening in the string comes with an associated locating profile and another profile for a locking dog to secure the straddle tool in position for forced delivery from the tool and into the valve assembly for delivery into the open hole annulus where a sealing ring of cement will set up for isolation. The operation sequentially put in place as many barriers as there are valve assemblies to straddle and in a single trip generally working in an uphole direction.

23 Claims, 2 Drawing Sheets

METHOD OF PLACING CEMENT SEALING RINGS AT PREDETERMINED ANNULAR LOCATIONS AROUND A TUBULAR STRING

FIELD OF THE INVENTION

The field of the invention is a method of placing cement at predetermined locations of an annular space around a tubular string for zonal isolation.

BACKGROUND OF THE INVENTION

Straddle tools to inflate external casing packers with cement are known and described in U.S. Pat. No. 5,082,062, U.S. Pat. No. 5,186,258, U.S. Pat. No. 5,366,019 and U.S. Pat. No. 5,692,564. Other external casing barriers have also been used such as swelling packers or hydraulically or mechanically compressed packers. These various packer designs present their own series of complications when multiple barriers need to be placed at spaced locations. The swell packers take a long time to reach sealing position while the mechanically set packers are of limited use in deviated boreholes. The hydraulically set packers require balls to be delivered to seat and need ball catchers for the balls once pushed through the seats. The ball seats may also need to be blown out to avoid reducing the size of the production flow passage once production begins.

More recently cement formulations have advanced to the point where commercially available cements can be pumped in a borehole and hold the position where the cement is placed despite the presence of borehole fluids.

The present invention allows for single trip placement of cement rings at predetermined locations on a tubular string where access to the open hole is provided. A straddle tool allows isolation of these access openings in sequence so that cement can be delivered into a surrounding annular space without need to perforate and squeeze cement into the annular gap and the surrounding formation. The cement can be spotted in the tool and once straddling access valves in the string cement can be sequentially delivered preferably in a single trip moving up the hole to define as many zones as needed for the completion before production starts. These and other aspects of the present invention will be more readily apparent to those skilled in the art from a review of the description of the preferred embodiment and the associated drawings while recognizing that the full scope of the invention is to be determined by the appended claims.

SUMMARY OF THE INVENTION

A method of providing cement isolators in an annular space about a tubular string in open hole uses a straddle tool that sequentially engages profiles in the tubular string so that prepositioned communication valves to the surrounding annulus can be straddled to force cement out through the straddle tool and into the annular space. The cement is formulated to stay in position and set up. Each valved opening in the string comes with an associated locating profile and another profile for a locking dog to secure the straddle tool in position for forced delivery from the tool and into the valve assembly for delivery into the open hole annulus where a sealing ring of cement will set up for isolation. The operation sequentially put in place as many barriers as there are valve assemblies to straddle and in a single trip generally working in an uphole direction.

DETAILED DESCRIPTION OF THE PREFERRED EMBODIMENT

Figure 1:
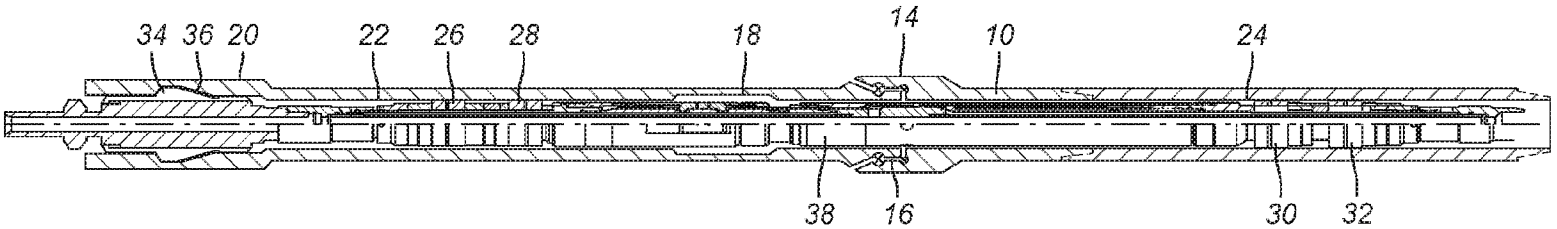
FIG. 1 is a section view of a straddle tool locked in straddling position about a valve assembly for access to the surrounding annulus.
Figure 2:
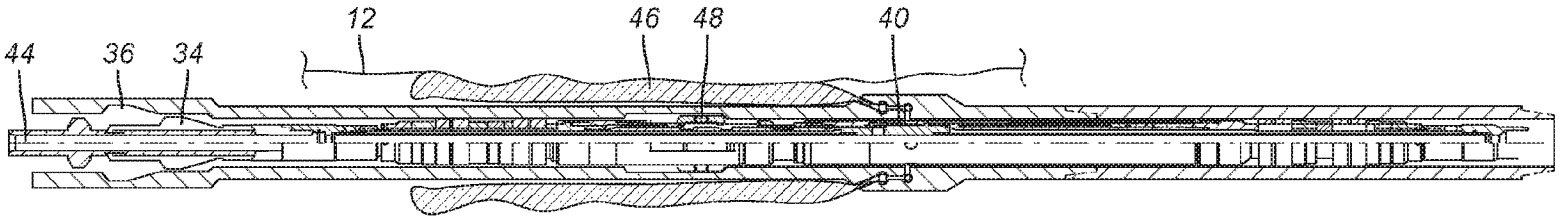
FIG. 2 is the view of FIG. 1 showing the onset of cement delivery.
Figure 3:
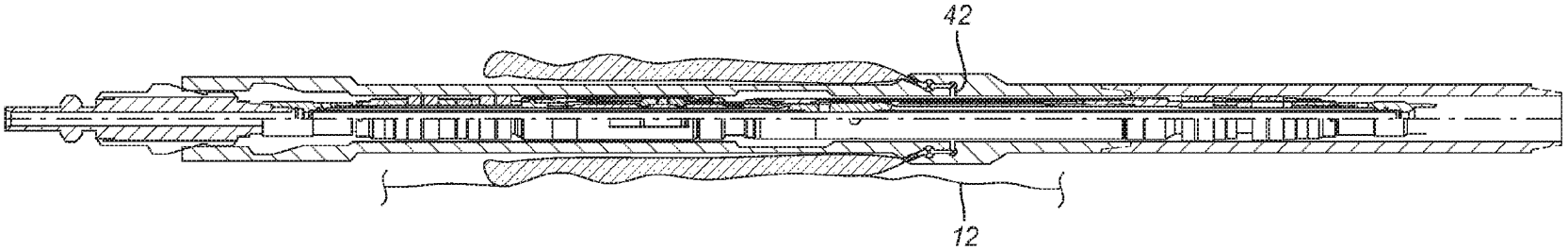
FIG. 3 is the view of FIG. 2 showing the cement pumping stopped and the tool released and ready to move uphole to another valve assembly or out to the surface.
Figure 4:
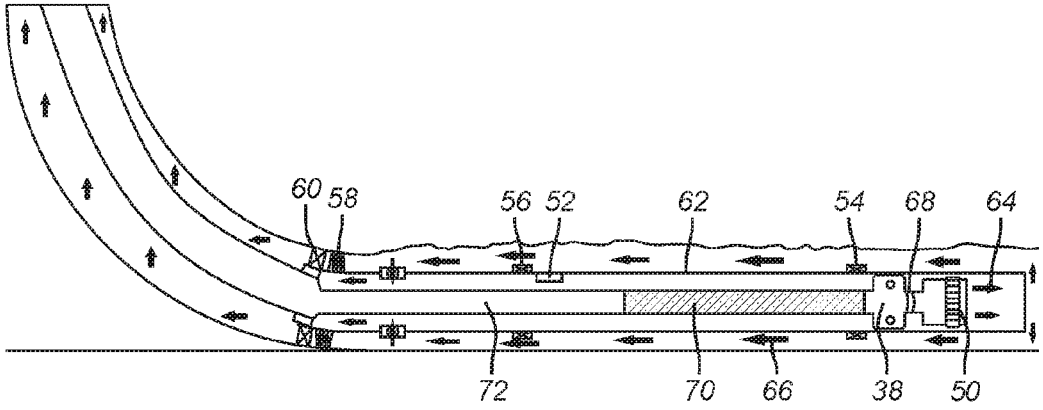
FIG. 4 is a schematic representation of the straddle tool being run in with circulation.

Referring to FIG. 1, the liner or casing string 10 is in an open borehole 12. One of several spaced cementing subs 14 are shown each has a valve assembly 16 which can be one or more valves such as one way valves that open with applied pressure and are snapped shut with spring force when cement pressure is removed. Dog recess 18 is just below collet recess 20 on the cementing sub 14. There are spaced seal bores 22 and 24 that are engaged by seal assemblies 26 and 28 on one side and seal assemblies 30 and 32 on the opposite side when the collets 34 land in collet groove 36. The FIG. 1 position gives surface personal a signal that the straddle tool 38 has its valve 40 in proximity of line 42 at the same time that seal assemblies 26, 28, 30 and 32 are respectively in pairs in seal bores 22 and 24. This positioning assures that cement 46 delivered under pressure into passage 44 of straddle tool 38 is forced into line 42 and through the valve assembly 16. FIG. 2 shows dogs 48 extended into dog recess 18 which has the effect of pulling down the straddle tool 38 while displacing the collets 34 out of grooves 36. FIG. 3 shows dogs 48 retracted as annular ring 46 is fully formed and stays in position in the surrounding well fluid and sets up to become a complete annular seal. The process is repeated at other locations adapted to support the straddle tool 38 to create another annular cement ring 46 at another location that is preferably uphole from the location shown in FIGS. 1-3 so that the process can take place in a single trip into the borehole after which the straddle tool 38 can be removed from the borehole as excess cement is reversed out.

Figure 5:
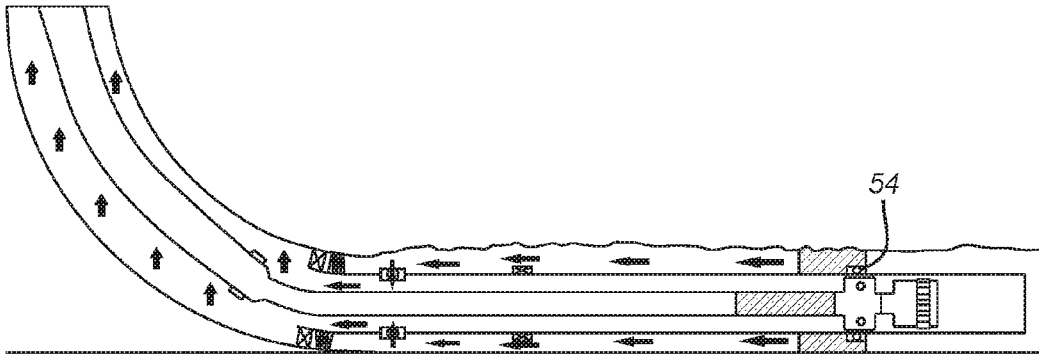
FIG. 5 is the view of FIG. 4 with the straddle tooled latched in position and cement delivery starting.
Figure 6:
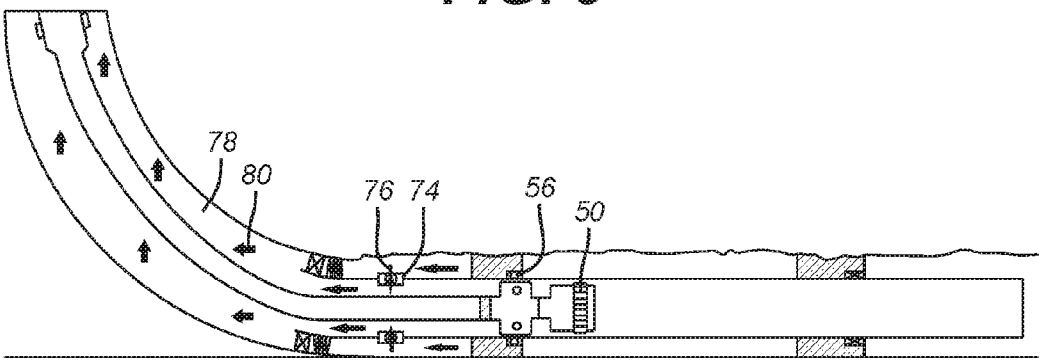
FIG. 6 is the view of FIG. 5 showing the straddle tool repositioned at a different valved access to the annulus and cement flow starting.

A wiper plug 68 can be launched ahead of a predetermined volume of cement 70 sufficient to make all the anticipated annular rings with some excess. Well fluid with another dart that is not shown can be pumped behind the cement to bump the plug 68 so that pressure can be built inside the straddle tool 38 to force cement 70 through the various valve assemblies such as 54 as shown in FIG. 5 and then 56 as shown in FIG. 6. The pumping of the cement 70 out through valve assemblies such as 54 and 56 will displace fluids through annular return valve 74 as indicated by arrow 76. If the packer 60 and the hanger 58 were previously set the displaced fluid represented by arrow 76 will be routed past gaps in the hanger 58 and through a mandrel passage in the packer 60 which is not shown so that the displaced well fluid can reach the upper annulus 78 as represented by arrows 80. It should be noted that shifting tool 50 can have an engagement profile for movement in opposed directions as is known in the art so that on tripping into the hole the valves such as 52 can be shifted to the open position and on tripping out of the hole the same valves can be engaged and closed. A sliding sleeve style for each such valve 52 located at each valve assembly such as 54 or 56 is preferred.

Figure 7:
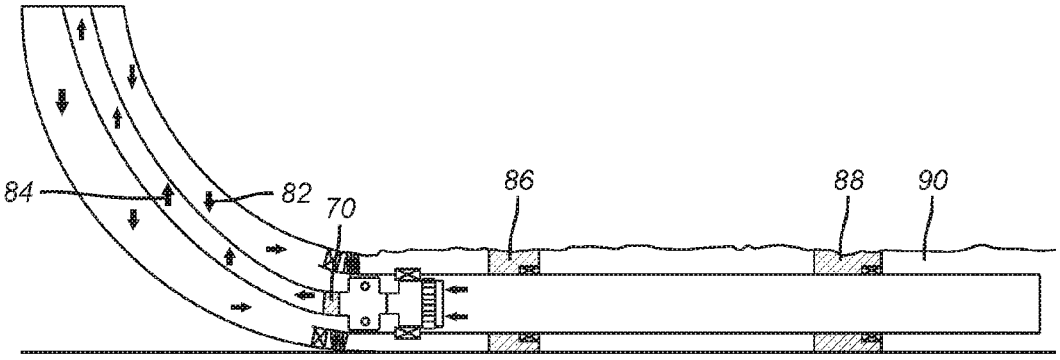
FIG. 7 is the view of FIG. 6 with the straddle tool being removed and excess cement removed with reverse flow.

As shown in FIG. 7 when the straddle tool is removed from the last pair of spaced seal bores described above it is possible to reverse out excess cement 70 using a flow regime indicated by arrows 82 and 84. By this time the annular cement rings such as 86 and 88 have all been created and are in the process of setting up in open hole 90.

The cement wiper plug ahead of the cement can also free a flapper valve to close to retain the cement instead of using the wiper plug for cement retention. Packer 60 can be set with pressure extended dogs and setting down weight in a manner known in the art. Pressure can also be used to extend dogs 48 to lock the straddle tool 38 to recess 18. Slacking off weight at that time indicates that the dogs 48 have extended for support of the straddle tool 38. Picking up releases dogs 48 to retract and relieving pressure allows valve 40 to close. Return valve 74 closes with a pick up force on the shifting tool 50.

Those skilled in the art will appreciate that the method allows for a single trip creation of annular barriers that stay where they are pumped in the annular space and set up to create multiple barriers as needed. A straddle tool is provided to allow charging the required volume of cement at each location and being able to take returns into the upper annulus through a return valve. This return valve can be configured to be selectively closed if needed for well control purposes. As many barriers as there are exit valve assemblies in the liner or casing string can be made before the straddle tool is removed from the borehole and excess cement is reversed out.

The above description is illustrative of the preferred embodiment and many modifications may be made by those skilled in the art without departing from the invention whose scope is to be determined from the literal and equivalent scope of the claims below:

We claim:

1. A one trip method for placement of spaced annular cement isolators in open hole about a tubular string, comprising:

supporting a tubular string comprising spaced valve assemblies in position in the open hole;

providing profiles on said string adjacent each of said valve assemblies;

running in a straddle tool assembly into said tubular string for sequential support on said profiles;

delivering cement under pressure through said straddle tool when said straddle tool is supported respectively on said profiles such that the pressurized cement is channeled to said associated valve assembly for delivery of cement through said respective valve assembly into contact with well fluid in the open hole to create an annular seal adjacent said valve assembly between said tubular string and a wall defining the open hole.

2. The method of claim 1, comprising:

providing a valved access for well fluid displaced by said cement through said tubular string in said tubular string and around an external packer on said tubular string.

3. The method of claim 2, comprising:

selectively operating said valved access with a shifter mounted to said straddle tool.

4. The method of claim 1, comprising:

circulating through said straddle tool during said running in.

5. The method of claim 1, comprising:

spotting sufficient said cement in said straddle tool for an annular seal adjacent each of said valve assemblies when said straddle tool is initially supported on said profiles.

6. The method of claim 5, comprising:

reversing out excess cement from said straddle tool after all said annular seals are in position.

7. The method of claim 5, comprising:

containing said cement in said straddle tool and a delivery string for said straddle tool before delivery of said cement through said valve assemblies.

8. The method of claim 1, comprising:

providing isolation valves within said tubular string adjacent each said valve assembly; operating said isolation valves with a shifter supported by said straddle tool.

9. The method of claim 1, comprising:

providing spaced seal assemblies on opposed sides of a wall opening in a mandrel of said straddle tool;

engaging said seal assemblies to opposing polished bores when said straddle tool is supported by any one of said profiles.

10. The method of claim 1, comprising:

providing as said valve assembly a plurality of cement valves that open with pressure to overcome a bias on a valve member, said valve member closing when the pressure is removed.

11. The method of claim 10, comprising:

configuring said cement valves allow flow in a single direction toward said well fluid in open hole.

12. The method of claim 1, comprising:

formulating said cement to stay where placed in well fluid and in an annular shape for creation of said annular seals.

13. The method of claim 1, comprising:

creating annular seals with said straddle tool in a bottom up direction toward a surface location in said one trip.

14. The method of claim 13, comprising:

spotting sufficient said cement in said straddle tool for an annular seal adjacent each of said valve assemblies when said straddle tool is initially supported on one of said profiles.

15. The method of claim 14, comprising:

reversing out excess cement from said straddle tool after all said annular seals are in position.

16. The method of claim 15, comprising:

providing isolation valves within said tubular string adjacent each said valve assembly; operating said isolation valves with a shifter supported by said straddle tool.

17. The method of claim 16, comprising:

providing spaced seal assemblies on opposed sides of a wall opening in a mandrel of said straddle tool;

engaging said seal assemblies to opposing polished bores when said straddle tool is supported by any one of said profiles.

18. The method of claim 17, comprising:

providing as said valve assembly a plurality of cement valves that open with pressure to overcome a bias on a valve member, said valve member closing when the pressure is removed; configuring said cement valves allow flow in a single direction toward said well fluid in open hole.

19. The method of claim 17, comprising:

operating said valves with said straddle tool assembly.

20. The method of claim 1, comprising:

operating said valves with said straddle tool assembly.

21. A one trip method for placement of spaced annular cement isolators in open hole about a tubular string, comprising:

supporting a tubular string comprising spaced valve assemblies in position in the open hole;

providing profiles adjacent each of said valve assemblies;

running in a straddle tool assembly into said tubular string for sequential support on said profiles;

delivering cement under pressure through said straddle tool when said straddle tool is supported respectively on said profiles such that the pressurized cement is channeled to said associated valve assembly for delivery of cement through said respective valve assembly into contact with well fluid in the open hole to create an annular seal adjacent said valve assembly between said tubular string and a wall defining the open hole;

providing a locating profile and a latch profile on said tubular string adjacent each said valve assembly;

initially positioning said straddle tool with a collet landed in locating profile;

extending at least one dog from said straddle tool and into said latch profile using internal pressure in said straddle tool, with said collet in said locating profile, to lock said straddle tool to said tubular string.

22. A one trip method for placement of spaced annular cement isolators in open hole about a tubular string, comprising:

supporting a tubular string comprising spaced valve assemblies in position in the open hole;

providing profiles adjacent each of said valve assemblies;

running in a straddle tool assembly into said tubular string for sequential support on said profiles;

delivering cement under pressure through said straddle tool when said straddle tool is supported respectively on said profiles such that the pressurized cement is channeled to said associated valve assembly for delivery of cement through said respective valve assembly into contact with well fluid in the open hole to create an annular seal adjacent said valve assembly between said tubular string and a wall defining the open hole;

supporting said tubular string with a liner hanger and liner top packer;

taking returns of said well fluid displaced by said cement past said packer and into an upper annulus above said liner top packer.

23. The method of claim 22, comprising:

providing a shifting tool on said straddle tool;

opening a return valve for displaced well fluid when running in said straddle tool by engaging the return valve with said shifting tool;

closing said return valve with said shifting tool when removing said straddle tool.

* * * * *